US009462366B2

(12) United States Patent
Silvestri et al.

(10) Patent No.: US 9,462,366 B2
(45) Date of Patent: Oct. 4, 2016

(54) EARPIECES HAVING FLEXIBLE FLAPS

(71) Applicant: Bose Corporation, Framingham, MA (US)

(72) Inventors: Ryan C. Silvestri, Franklin, MA (US); Michael D. Ting, Boston, MA (US)

(73) Assignee: Bose Corporation, Framingham, MA (US)

( * ) Notice: Subject to any disclaimer, the term of this patent is extended or adjusted under 35 U.S.C. 154(b) by 34 days.

(21) Appl. No.: 14/227,291

(22) Filed: Mar. 27, 2014

(65) Prior Publication Data

US 2015/0281819 A1 Oct. 1, 2015

(51) Int. Cl.

| | |
|---|---|
| ***H04R 25/02*** | (2006.01) |
| ***H04R 1/10*** | (2006.01) |
| *H04R 25/00* | (2006.01) |

(52) U.S. Cl.

CPC ..... *H04R 1/1016* (2013.01); *H04R 1/1083* (2013.01); *H04R 2460/15* (2013.01); *H04R 2460/17* (2013.01)

(58) Field of Classification Search

CPC ..... H04R 1/10; H04R 1/1016; H04R 1/105; H04R 25/02; H04R 25/652; H04R 25/656; H04R 25/65

USPC ..... 181/129, 130, 131, 134, 135; 381/322, 381/324, 328, 329, 374, 380

See application file for complete search history.

(56) References Cited

U.S. PATENT DOCUMENTS

| | | | | |
|---|---|---|---|---|
| 588,099 | A | | 8/1897 | Blount |
| 931,768 | A | | 8/1909 | Kirkpatrick |
| 1,564,474 | A | | 12/1925 | Fensky |
| 1,614,987 | A | | 1/1927 | Langbeck et al. |
| 1,668,890 | A | | 5/1928 | Curran et al. |
| 1,688,910 | A | | 10/1928 | Winship |
| 1,753,817 | A | | 4/1930 | Aber |
| 1,893,143 | A | | 1/1933 | Koch |
| 1,969,559 | A | | 8/1934 | Kelly |
| 2,437,490 | A | | 3/1948 | Watson |
| 2,487,038 | A | | 8/1949 | Baum |
| 2,521,414 | A | | 9/1950 | Schier |
| 2,538,339 | A | | 1/1951 | Thomas |
| 2,545,731 | A | | 3/1951 | French |
| 2,763,334 | A | | 9/1956 | Starkey |
| 2,908,343 | A | * | 10/1959 | Hummert ..... 181/130 |
| 3,053,061 | A | | 9/1962 | French |
| 3,157,245 | A | | 11/1964 | Bernstein |

(Continued)

FOREIGN PATENT DOCUMENTS

| | | |
|---|---|---|
| CA | 2689100 | 12/2008 |
| DE | 351644 | 4/1922 |

(Continued)

OTHER PUBLICATIONS

International Search Report and Written Opinion; PCT/US2015/022767; Jul. 1, 2015; 17 pp.

(Continued)

*Primary Examiner* — Edgardo San Martin
(74) *Attorney, Agent, or Firm* — Fish & Richardson P.C.

(57) ABSTRACT

Among other things, an ear tip for an earpiece is described. The ear tip comprises a body and two flexible flaps extending from the body. The two flexible flaps together form a generally frusto-conical shape around the body and at least part of the body is partially enclosed by the two flexible flaps.

24 Claims, 13 Drawing Sheets

(56) References Cited

U.S. PATENT DOCUMENTS

D221,442 S 8/1971 Feingold
3,935,401 A * 1/1976 Shore et al. ..... 181/135
4,010,820 A 3/1977 Johnson
4,055,233 A 10/1977 Huntress
4,219,018 A 8/1980 Draper, Jr.
D266,590 S 10/1982 Bennett
4,353,364 A 10/1982 Woods
D274,814 S 7/1984 Tang
4,540,063 A 9/1985 Ochi et al.
4,646,872 A 3/1987 Kamon et al.
4,870,688 A 9/1989 Voroba et al.
4,896,679 A 1/1990 St. Pierre
D316,550 S 4/1991 Sogabe
D318,670 S 7/1991 Taniguchi
5,048,090 A 9/1991 Geers
5,055,233 A 10/1991 Borland et al.
D326,655 S 6/1992 Iribe
5,222,151 A 6/1993 Nagayoshi et al.
5,449,865 A 9/1995 Desnick et al.
5,548,643 A 8/1996 Dalgleish et al.
5,625,171 A 4/1997 Marshall
5,654,530 A * 8/1997 Sauer et al. ..... 181/130
5,668,354 A 9/1997 Falco
D388,093 S 12/1997 Frengley
5,712,453 A 1/1998 Bungardt et al.
5,727,566 A 3/1998 Leight
5,887,070 A 3/1999 Iseberg et al.
5,957,136 A 9/1999 Magidson et al.
6,022,311 A 2/2000 Juneau et al.
D430,139 S 8/2000 Peters et al.
D430,547 S 9/2000 Yoon
D430,860 S 9/2000 Yoon
6,129,175 A 10/2000 Tutor et al.
6,241,041 B1 6/2001 Leight
RE37,398 E 10/2001 Nageno
6,449,374 B1 9/2002 Skulley et al.
D469,755 S 2/2003 Hlas et al.
D470,122 S 2/2003 Hlas et al.
D470,123 S 2/2003 Hlas et al.
D470,128 S 2/2003 Hlas et al.
D470,129 S 2/2003 Hlas et al.
D471,537 S 3/2003 Ham
D471,890 S 3/2003 Clarkson
D473,204 S 4/2003 Tanio
D478,991 S 8/2003 Dyer et al.
6,690,807 B1 2/2004 Meyer
6,795,718 B2 9/2004 Bae
6,819,762 B2 11/2004 Jones et al.
6,820,717 B2 11/2004 Fleming et al.
6,856,690 B1 2/2005 Skulley
6,868,284 B2 3/2005 Bae
6,879,697 B2 4/2005 Topholm
D505,132 S 5/2005 Linville et al.
6,944,307 B2 9/2005 Berg
D510,574 S 10/2005 Okada
6,961,440 B1 11/2005 Schlaegel
7,050,599 B2 5/2006 Baskerville
7,068,803 B2 6/2006 Kuhlmann et al.
D525,962 S 8/2006 Elson
D538,271 S 3/2007 Kim et al.
7,233,676 B2 6/2007 Bayer
D558,735 S 1/2008 Carr et al.
7,340,075 B2 3/2008 Bayer
D566,099 S 4/2008 Komiyama
D566,691 S 4/2008 Andre et al.
D568,302 S 5/2008 Oh
D569,841 S 5/2008 Chung et al.
7,394,910 B2 7/2008 Smith et al.
D575,277 S 8/2008 Gaarde et al.
D575,772 S 8/2008 Schultz et al.
7,412,068 B2 8/2008 Bayer
D578,507 S 10/2008 Ando
D578,508 S 10/2008 Wang
D579,006 S 10/2008 Kim et al.
D582,389 S 12/2008 Bose et al.
D582,397 S 12/2008 Christopher
D582,398 S 12/2008 Nam et al.
D582,889 S 12/2008 Bose et al.
D584,284 S 1/2009 Carr et al.
D584,294 S 1/2009 Nam et al.
D585,881 S 2/2009 Nam et al.
D588,099 S 3/2009 Yuyama
D589,945 S 4/2009 Esses
7,536,008 B2 5/2009 Howes et al.
D596,164 S 7/2009 Henning
D601,134 S 9/2009 Elabidi et al.
D602,476 S 10/2009 Lee et al.
7,600,604 B2 10/2009 Babcock et al.
D605,170 S 12/2009 Keinanen
D605,628 S 12/2009 Ando
7,627,131 B2 * 12/2009 Nielsen et al. ..... 381/328
D607,875 S 1/2010 Pedersen, II
D618,219 S 6/2010 Burgett et al.
D618,221 S 6/2010 Fahrendorff et al.
D620,927 S 8/2010 Li
D621,817 S 8/2010 Brickstad
D622,265 S 8/2010 Rye
D622,704 S 8/2010 Fahrendorff et al.
7,778,410 B2 8/2010 Liu et al.
7,778,435 B2 8/2010 Smith et al.
D628,188 S 11/2010 Koch
7,886,745 B2 2/2011 Purcell et al.
D633,481 S 3/2011 Chen
D634,305 S 3/2011 Hoggarth
7,949,127 B2 5/2011 Pedersen et al.
D640,670 S 6/2011 Rye
7,965,855 B1 6/2011 Ham
D641,008 S 7/2011 Lee et al.
D641,747 S 7/2011 Gisborne
D645,458 S 9/2011 Silvestri et al.
8,121,325 B2 2/2012 Atamaniuk et al.
8,208,676 B2 * 6/2012 Murozaki et al. ..... 381/386
8,249,287 B2 8/2012 Silvestri et al.
8,252,621 B2 8/2012 Basol
8,254,621 B2 8/2012 Silvestri et al.
8,270,648 B2 9/2012 Murozaki
8,280,093 B2 10/2012 Siahaan et al.
8,311,253 B2 11/2012 Silvestri et al.
8,355,522 B2 1/2013 Annunziato et al.
8,600,096 B2 12/2013 Lin
8,638,970 B2 * 1/2014 Burton ..... H04R 1/1016 181/135
2002/0096391 A1 7/2002 Smith et al.
2002/0172386 A1 11/2002 Bayer
2003/0091210 A1 5/2003 Baskerville
2003/0174853 A1 9/2003 Howes et al.
2004/0045558 A1 3/2004 Taylor et al.
2004/0163653 A1 8/2004 Fleming
2005/0008180 A1 1/2005 Smith et al.
2005/0147269 A1 7/2005 Oliveira et al.
2006/0067556 A1 3/2006 Bailey et al.
2006/0177080 A1 * 8/2006 Smith ..... 381/313
2006/0188122 A1 8/2006 Smith
2006/0215864 A1 9/2006 Espersen et al.
2007/0116309 A1 5/2007 Smith
2007/0183615 A1 8/2007 Wurfel
2007/0254725 A1 11/2007 Smith
2008/0085030 A1 4/2008 Smith
2008/0159577 A1 7/2008 Smith
2008/0181441 A1 7/2008 Smith
2008/0247561 A1 10/2008 Smith
2009/0092269 A1 4/2009 Nielsen et al.
2009/0101433 A1 4/2009 Stiehl et al.
2009/0123010 A1 5/2009 Cano et al.
2009/0141923 A1 6/2009 Smith
2009/0180654 A1 7/2009 Nielsen
2009/0202094 A1 8/2009 Ammitzboll et al.
2009/0226025 A1 9/2009 Howes et al.
2009/0323993 A1 12/2009 Slemming et al.
2010/0086158 A1 4/2010 Oberlander
2010/0098281 A1 4/2010 Urso et al.
2010/0278364 A1 11/2010 Berg
2011/0051979 A1 3/2011 Lee et al.
2011/0091061 A1 4/2011 Von Dombrowski et al.

(56) References Cited

U.S. PATENT DOCUMENTS

| | | | | |
|---|---|---|---|---|
| 2011/0268308 | A1 | 11/2011 | Vasquez | |
| 2013/0148838 | A1 | 6/2013 | Silvestri et al. | |
| 2013/0230204 | A1 | 9/2013 | Monahan et al. | |
| 2013/0315410 | A1* | 11/2013 | Annunziato et al. | 381/71.6 |
| 2014/0079273 | A1 | 3/2014 | Silvestri et al. | |
| 2014/0294214 | A1* | 10/2014 | Zhao et al. | 381/330 |

FOREIGN PATENT DOCUMENTS

| | | |
|---|---|---|
| DE | 8328154 | 2/1984 |
| DE | 29718483 | 2/1999 |
| DE | 202011002165 | 5/2011 |
| EP | 368125 | 5/1990 |
| EP | 786241 | 7/1997 |
| EP | 1355508 | 10/2003 |
| EP | 1377113 | 1/2004 |
| EP | 1448014 | 8/2004 |
| EP | 1594340 | 11/2005 |
| EP | 1874080 | 1/2008 |
| FR | 2437802 | 4/1980 |
| GB | 239478 | 5/1926 |
| GB | 365962 | 1/1932 |
| JP | S58-104077 | 7/1983 |
| JP | 07-115695 | 5/1995 |
| JP | 07-170591 | 7/1995 |
| JP | 08-172691 | 7/1996 |
| JP | 10-066181 | 3/1998 |
| JP | 11-308685 | 11/1999 |
| JP | 2000115876 | 4/2000 |
| JP | 2001333484 | 11/2001 |
| JP | 2002058086 | 2/2002 |
| JP | 2005184579 | 7/2005 |
| JP | 3159710 | 5/2010 |
| NO | 328038 | 11/2009 |
| WO | 96/37052 | 11/1996 |
| WO | 99/39544 | 8/1999 |
| WO | 01/50813 | 7/2001 |
| WO | 01/50993 | 7/2001 |
| WO | 0245390 | 6/2002 |
| WO | 03/075608 | 9/2003 |
| WO | 2004068896 | 8/2004 |
| WO | 2004/100508 | 11/2004 |
| WO | 2006/084172 | 8/2006 |
| WO | 2006/104981 | 10/2006 |
| WO | 2007/028659 | 3/2007 |
| WO | 2007/044766 | 4/2007 |
| WO | 2008/147215 | 4/2008 |
| WO | WO 2008/051307 | 5/2008 |
| WO | 2008/086286 | 7/2008 |
| WO | 2009/018825 | 2/2009 |
| WO | 2009/030229 | 3/2009 |
| WO | 2009/077145 | 6/2009 |
| WO | 2009/153221 | 12/2009 |
| WO | 2010/031775 | 3/2010 |
| WO | 2010/040370 | 4/2010 |
| WO | 2010040350 | 4/2010 |
| WO | 2010040351 | 4/2010 |
| WO | WO 2010-040350 | 4/2010 |
| WO | WO 2010-040351 | 4/2010 |
| WO | 2011/007448 | 1/2011 |
| WO | WO 2011/076246 | 6/2011 |
| WO | WO 2013/016336 | 1/2013 |
| WO | WO 2013/180571 | 12/2013 |

OTHER PUBLICATIONS

Why Use Parylene Coatings?, Parylene Engineering (2010).
NuSil Technology Releases Low Coefficient of Friction Silicon Coating for Healthcare Applications, Special Chem. (2010).
Types and Properties of Moldable Silicone Rubber, Albright Technologies, Inc. (2011).
Coefficients of Friction for Teflon (2004).
Acheson, Emralon 8301 Product Data Sheet, retrieved from the Internet on May 23, 2013: http://henkelcorp.com/industrial/product-search-1554.thm?nodeid=8798045667329.

* cited by examiner

EARPIECES HAVING FLEXIBLE FLAPS

TECHNICAL FIELD

This disclosure generally relates to earpieces for use with electronic devices, which may include one or more flexible flaps.

BACKGROUND

Earpieces can be placed within human ears, e.g., as part of earphones, Bluetooth devices, etc., to deliver sound to the ears. To enhance sound quality and the user's acoustic experience, earpieces may be configured to enhance passive noise attenuation. For example, an earpiece may substantially seal the entrance of a user's ear canal so that sound delivered to the ear does not leak to the external environment, and so other sounds, e.g., the passive noise, from the environment, are substantially blocked. In another example, an earpiece may have an incomplete seal to allow for situational awareness. The earpiece may provide a desired level of acoustic leak.

SUMMARY

In one aspect, the disclosure features an ear tip for an earpiece. The ear tip comprises a body and two flexible flaps extending from the body. The two flexible flaps together form a generally frustro-conical shape around the body and at least part of the body is partially enclosed by the two flexible flaps.

In another aspect, the disclosure features an ear tip comprising a body, a positioning and retaining structure, and two or more flaps extending from and connected to the body. The two or more flaps form a frusto-conical shape. The positioning and retaining structure includes a member extending from the body and configured to rest against and apply outward pressure to the antihelix of a user's ear to retain the ear tip in the user's ear.

In another aspect, the disclosure features an ear tip for an earpiece. The ear tip comprises a body and two compliant flaps together forming a frusto-conical structure surrounding the body. At least part of the body is partially enclosed by the frusto-conical structure. The two flaps each has an inner perimeter connected to the body and an outer perimeter away from the body. The two flaps also each comprises two ends each extending between the inner perimeter and the outer perimeter. At least two ends of the two flaps overlap along a peripheral direction of the inner or outer perimeters in an overlapping region.

In another aspect, the disclosure features an earpiece comprising a body defining an opening as an acoustic passage to conduct sound waves, two flaps connected to the body, and an acoustic driver configured to radiate sound waves to be conducted through the acoustic passage. Each flap is flexible in response to applied force so as to enclose at least part of the body.

Embodiments of the ear tips and earpieces may include one or more of the following features. A first flap of the two flaps is smaller in size than a second flap of the two flaps. The body comprises a front part and a back part, and the first flap is connected to the body at a location such that when the ear tip is held in a human ear with the front part of the body positioned at the entrance to the ear canal, the first flap is on an inner side of the tragus of the human ear. The first flap has the shape of a portion of a first oval and has a size smaller than half of the first oval. The second flap has the shape of a portion of a second oval and has a size larger than half of the second oval. A first flap of the two flaps is connected to the body at a first inner perimeter, and has a first outer perimeter and first and second ends extending between the first inner perimeter and the first outer perimeter. A second flap of the two flaps is connected to the body at a second inner perimeter, and has a second outer perimeter and third and fourth ends extending between the second inner perimeter and the second outer perimeter. The first end overlaps with the third end along the first and second inner perimeter, and the second end overlaps with the fourth end along the first and second inner perimeter. The first and third ends are separated by a gap having a width of about 0 mm to about 1 mm at the first and second perimeters. The first and third ends are separated by a gap having a width of about 0.1 mm to about 1.6 mm at the first and second outer perimeters. Each flap has a thickness of about 0.15 mm to about 1.5 mm. The body comprises a front part and a back part, and the back part of the body comprises a surface having a first region having a round shape and one or more second, flat regions under the one or more flaps. The flaps are configured to bend towards the body so that the ends in the overlapping region slide towards each other along the peripheral direction to increase an amount of the overlap. The ear tip comprises three or more flaps. The two flaps comprise silicone. There are exactly two flaps. A first flap of the two flaps is smaller in size than a second flap of the two flaps. The two flaps each have an inner perimeter connected to the body and an outer perimeter away from the body, the flaps also each have two ends each extending between the inner perimeter and the outer perimeter, and at least two ends of the flaps overlap along a peripheral direction of the inner or outer perimeters in an overlapping region. The earpiece comprises three or more flaps that mutually engage to form a conical structure. The frusto-conical shape has an aperture angle of about 30 degrees to about 90 degrees. The ear tip comprises at least two flaps having ends overlap in an overlapping region. The positioning and retaining structure forms a consistent leak of sound external to the human ear to the human ear in the overlapping region.

Two or more of the features described in this disclosure, including those described in this summary section, may be combined to form implementations not specifically described herein.

The details of one or more implementations are set forth in the accompanying drawings and the description below. Other features, objects, and advantages will be apparent from the description and drawings, and from the claims.

DETAILED DESCRIPTION

An example earpiece includes a tip that can fit ears of different users having a range of sizes and geometries. The tip can also seal to the ears of different users, thereby enhancing user-experienced sound quality. The tip may include one or more petal flaps surrounding a body of the tip. The flap(s) can form a frusto-conical shape, which has a bottom having an oval shape. The flap(s) can also have other shapes, e.g., a bulb shape. The flap(s) can be a continuous piece of material having at least one break along the generatrix of the cone and two ends along a peripheral direction of the bottom of the frusto-conical shape. Each end may extend between a top and the bottom of the frusto-conical shape. In some implementations, two or more petal flaps having the same or different dimensions are arranged along the circumference of the tip body and in combination form the frusto-conical shape. The ends of the flap(s) can overlap along the peripheral direction.

The flap(s) can allow the tip to be inserted flexibly at different depths of the ear canals to provide an acoustic seal or acoustic coupling to the ear. In some implementations, the acoustic seal is a passive noise seal. In some implementations, the flap(s) can provide a given consistent leak into the ear canal, e.g., by tuning parameters associated with the flap(s), e.g., flap thickness(es) and air gap molded in between ends of the flap(s). The details of these parameters are discussed further below. The flaps can be configured to seal to a user's ear at the entrance of the ear canal to create a consistent coupling to the user's ear canal. The flap(s) can conform to the irregular geometry of a user's ear canal entrance by compressing outer perimeter(s) of the flaps and increasing the overlap between the ends at the outer perimeter(s). The seal to the user's ear can be formed farther out along the user's ear canal than the seal formed by a tip without the flap(s). As some users have ear canals that are sensitive, placing the tip farther out, near the entrance of the ear canal, can result in a more comfortable fit. In addition, a tip having the flap(s) can fit differently sized ears more easily than a tip without such flap(s). When adjusted along the major axis of an ear canal, the flap(s) can change their shapes to conform to the unique ear geometry and change length(s) of the outer perimeter(s). For example, the flap(s) can flexibly provide a large initial frusto-conical geometry, in which the petals are uncompressed or slightly compressed to accommodate large ears. The flap(s) can also be compressed to fit smaller ears when the ends of the flap(s) slide past one another, reducing the effective cone size.

In the example implementations described herein, the left and right earpieces mirror each other, but have the same structure and function. Features of the right earpiece are described below. The left earpiece has the same features in this example implementation.

Figure 1A:
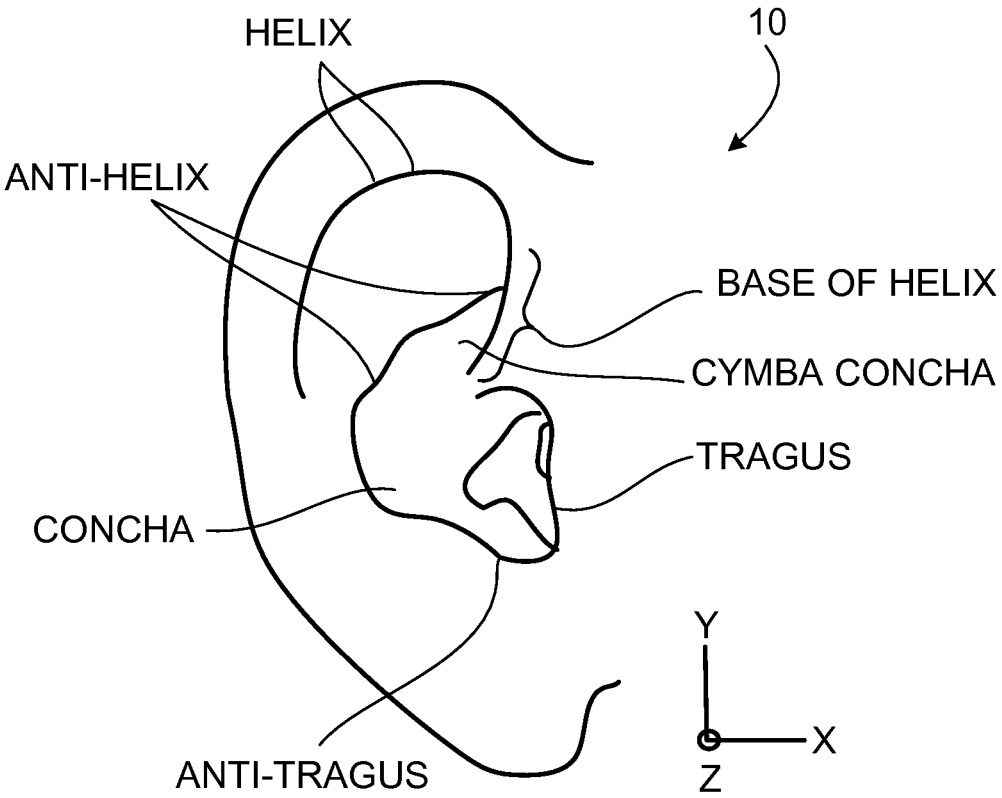
FIG. 1A is a schematic view of a lateral surface of a human ear.

FIG. 1A shows the lateral surface of a human right ear 10, with features of the ear identified. However, different ears have different sizes and geometries. In this regard, the precise structure of the human ear varies from individual to individual. For example, some ears have additional features that are not shown in FIG. 1A, and some ears may lack some of the features that are shown in FIG. 1A. Likewise, some features of different ears may be more or less prominent than those shown in FIG. 1A.

Figure 1B:
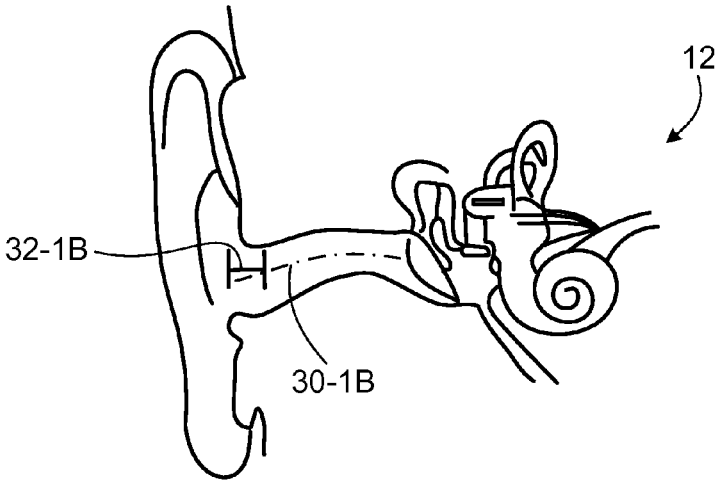
FIGS. 1B and 1C are schematic cross-sectional views of human ears.
Figure 1C:
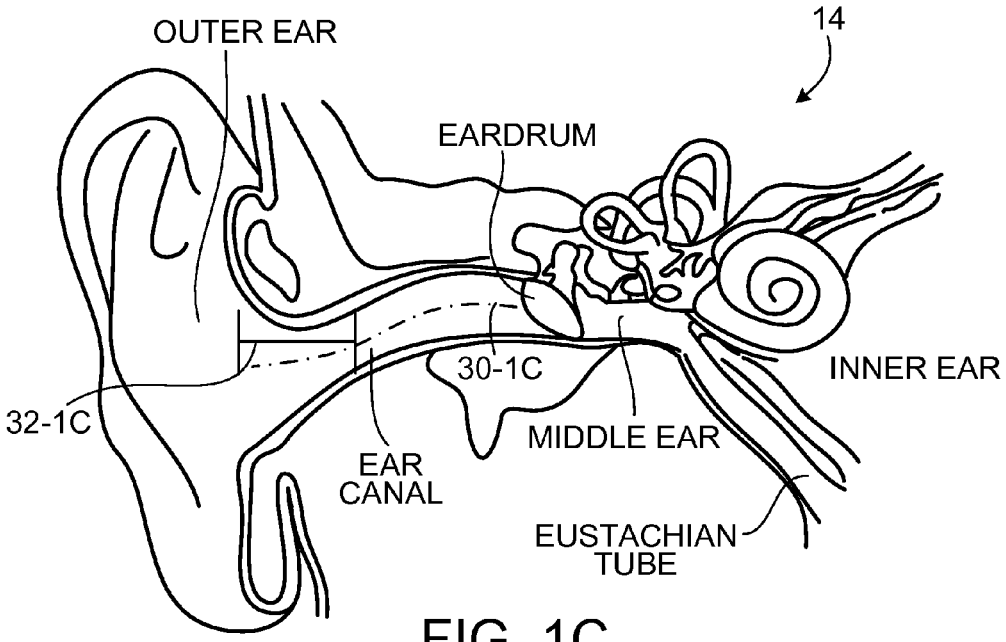

FIGS. 1B and 1C show two cross-sections of the human ears 12, 14. In these examples, the ear canal is an irregularly shaped cylinder having a variable cross-sectional area and a center line that is not straight. Among the features identified in the figures are the entrance to the ear canal and the main portion of the ear canal. In the example, the entrance to the ear canal corresponds to the portion of the ear canal near the concha, where the walls of the ear canal are substantially non parallel to the center line of the ear canal. In contrast to the ear of FIG. 1C, the ear of FIG. 1B has a relatively sharp transition from ear canal walls that are non-parallel to a center line 30-1B of the ear canal to walls that are substantially parallel to a center line of the ear canal. The ear shown in FIG. 1C has a more gradual transition from walls that are non-parallel to a centerline 30-1C of the ear canal to walls that are substantially parallel to the centerline 30-1C of the ear canal. The entrance 32-1C to the ear canal is relatively long compared to the entrance 32-1B.

Figure 2:
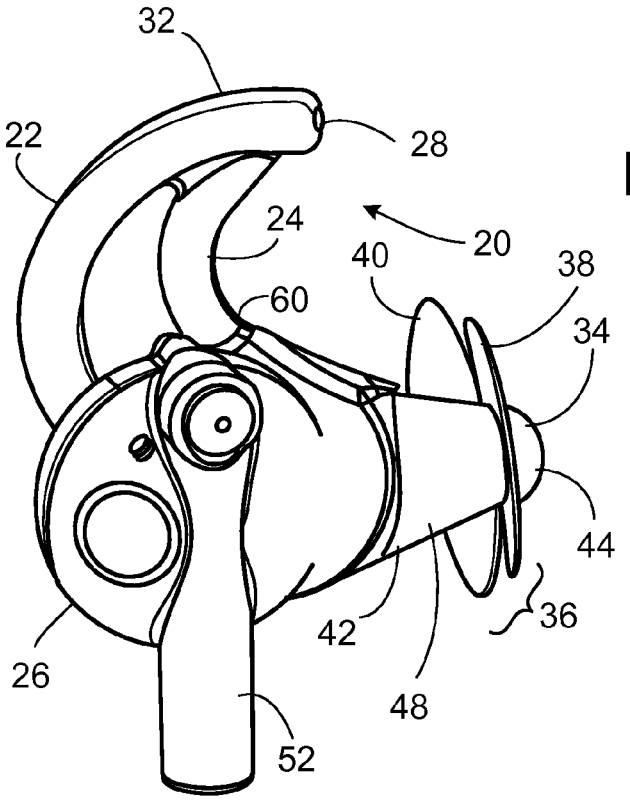
FIG. 2 is an isometric view of an example earpiece.
Figure 2A:
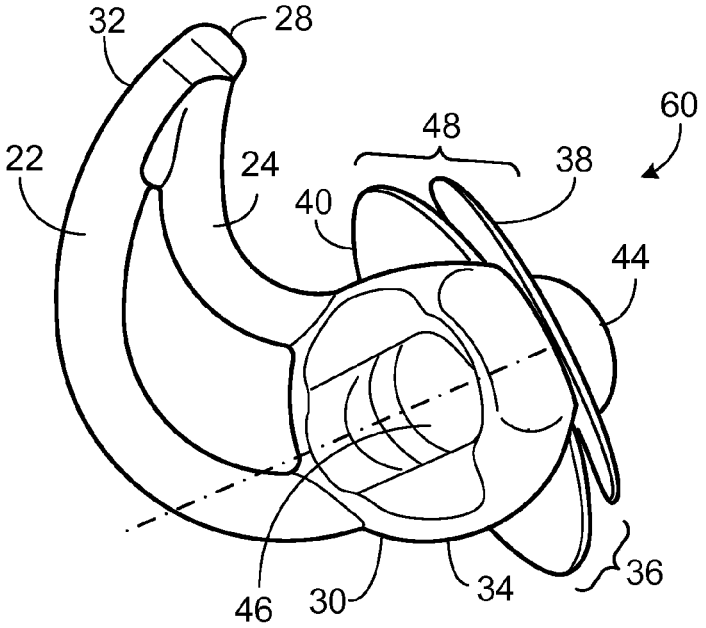
FIG. 2A is an isometric view of an example tip of an earpiece.

FIG. 2 shows an example earpiece 20 that is configured to fit in ears 10, 12, 14 of FIGS. 1A-1C. The earpiece 20 includes a stem 52 for positioning cabling and the like to receive audio signals to be delivered to an ear, an acoustic driver module 26, and a tip 60, which is also shown in FIG. 2A. Some earpieces may lack the stem 52, but may include an electronics module (not shown) for wirelessly communicating with external devices. Some ear pieces may include the driver and acoustics but lack stem 52 and electronics module. Other earpieces may lack the stem and the acoustic driver module and may function as passive earplugs. In this context, a passive earplug includes an earplug that does not include acoustic features, i.e., they do not provide sound to the ear.

FIG. 2A shows an example tip of the earpiece of FIG. 2. The tip 60 includes a positioning and retaining structure 28 connected to a sealing structure 48. The positioning and retaining structure 28 includes an outer leg 22 and an inner leg 24 that are joined to the sealing structure 48 at one end 30 and that are joined to each other at the other end 32. The sealing structure includes a body 34 and two petal flaps 38, 40 forming a frusto-conical structure 36. The body 34 includes a back part 42 that is at least partially covered by, or under, the frusto-conical structure 36, and a front part 44 that extends beyond the frusto-conical structure 36. The body 34 defines an opening 46 extending from the back part 42 to the front part 44. In the back part 42, the acoustic driver module 26 and the stem 52 can mount to the opening 46. In the front part, sound waves can be delivered through the opening to an ear. Although not shown in the figures, in some implementations, the entire body 34, including the front and the back parts 44, 42, is covered, or under, the frusto-conical structure. Sometimes part of the body 34, e.g., the front part 44, is also called a nozzle.

Figure 2B:
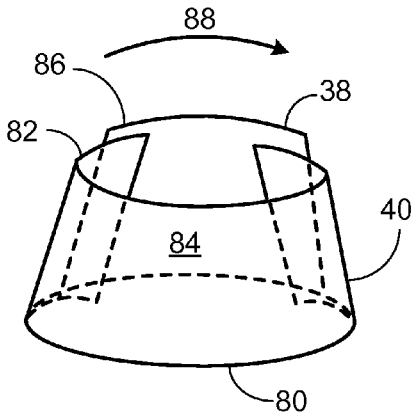
FIG. 2B is a schematic view of a frusto-conical structure.

FIG. 2B shows an example frusto-conical structure 36 that is formed from the combination of two petal flaps 38, 40. The bottom 80 of the structure 36 has an oval- or elliptical-like shape. The perimeter of the bottom 80 corresponds to the outer perimeters of the two flaps 38, 40. The top 82 of the structure 36 has a shape that corresponds to the cross-sectional shape of the front part 44 of the body 34. For example, the shape can be substantially oval, elliptical, or circular. The perimeter of the top 82 corresponds to the inner perimeters of the two flaps 38, 40, at which the flaps connect to the body 34. The cone surface 84 between the top 82 and the bottom 80 corresponds to outer surfaces of the flaps 38, 40 that face an ear wall when the tip 60 is placed in an ear. As is shown in the figure, neither of the bottom 80 nor the top 82 has a perfect oval elliptical or circular shape. This is because there is a gap 86 between the two flaps and the ends of the flaps overlap along a peripheral direction 88. Accordingly, the outer surfaces of the flaps do not form a continuous surface. The details of the gap and the overlapping are discussed further below.

Figure 2C:
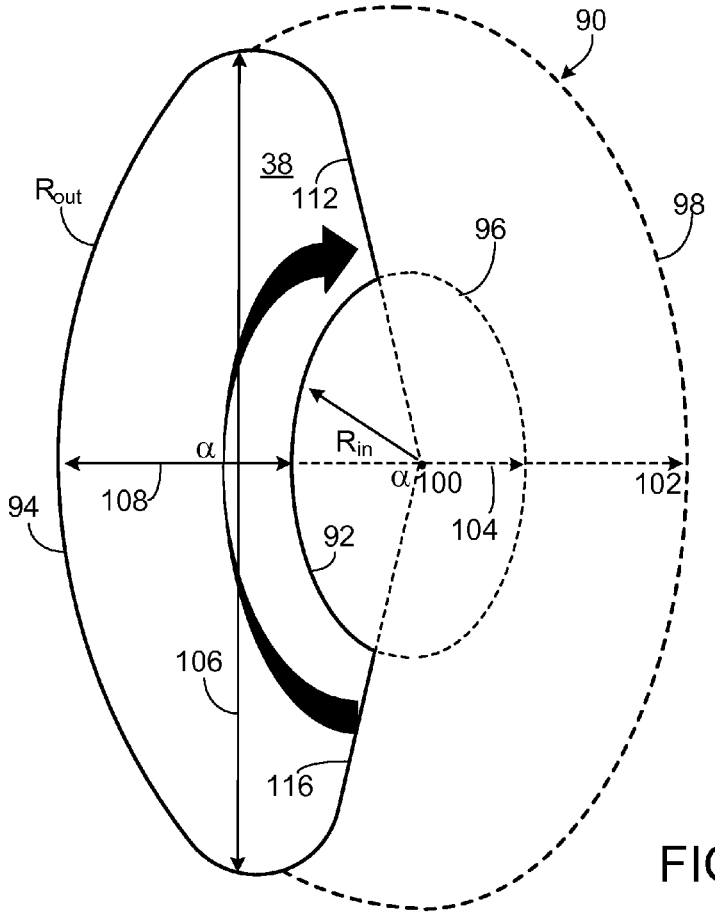
FIGS. 2C and 2D are top views of example petal flaps.
Figure 2D:
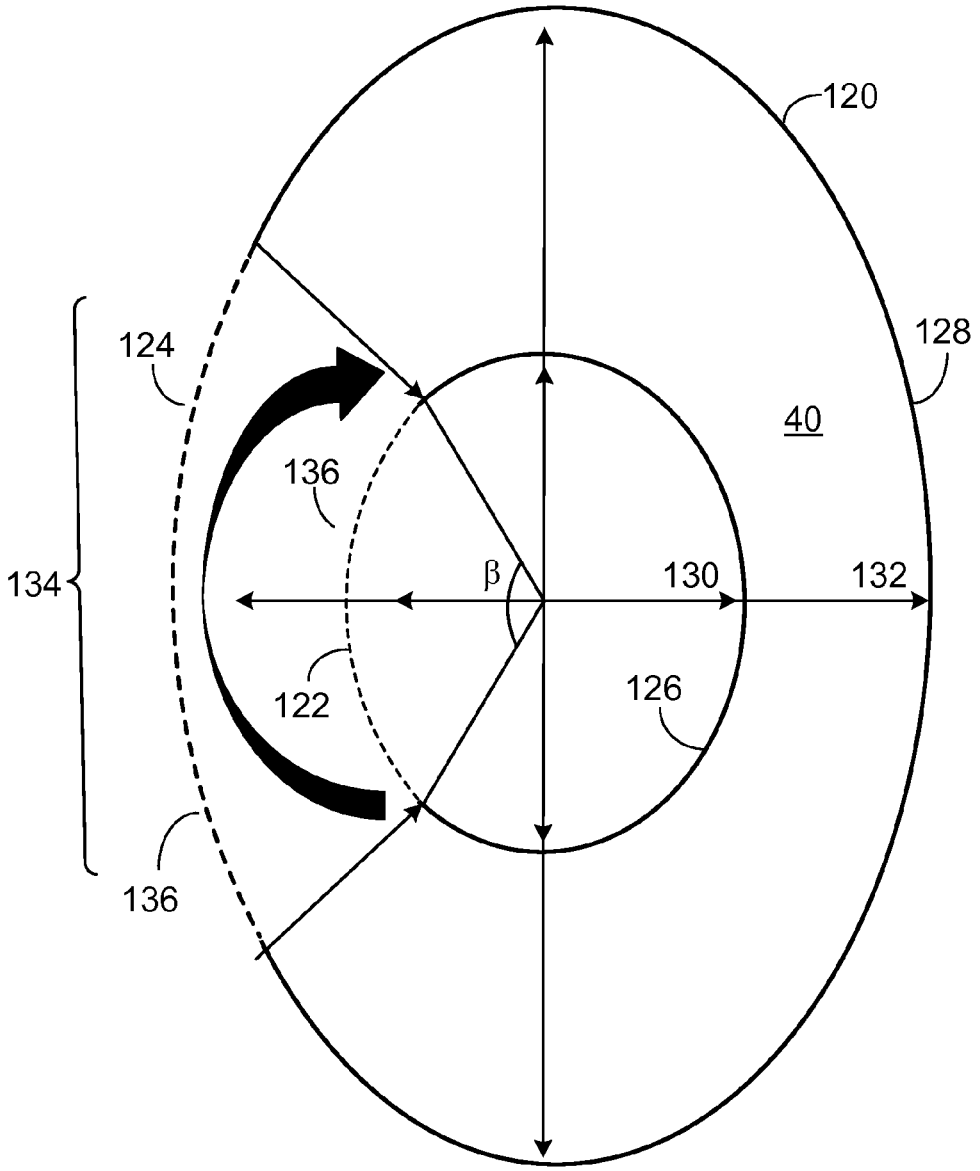

FIGS. 2C and 2D show top views of example petal flaps that form the frusto-conical structure 36 of FIGS. 2A and 2B. In some implementations, the two flaps 38, 40 have different shapes and sizes. Referring in particular to FIGS. 2 and 2C, the petal flap 38 generally can be viewed as a portion of a shape 90. The flap 38 has an inner perimeter 92 that is part of a small inner oval 96, and has an outer perimeter 94 that is part of a large outer oval 98. The inner perimeter 92 connects to the body 34 of the tip 60. In some implementations, the petal flap 38 is less than half of the total size of the shape 90 and is symmetric relative to a short axis 104 of the inner oval 96 or a short axis 102 of the outer oval 98. The part of the inner oval 96 forming the inner perimeter 92 corresponds to a central angle $\alpha$ from a center 100 of the inner oval 96. In some implementations, the angle $\alpha$ may also correspond to an angle between flap edges 112, 116. In some implementations, the angle $\alpha$ is smaller than 180 degrees, e.g., about 95 degrees to about 175 degrees, or about 157.5 degrees. The part of the outer oval 98 forming the outer perimeter 94 may correspond to the same central angle $\alpha$ or a different central angle of the outer oval 98.

Referring to FIGS. 2 and 2D, the petal flap 40 can also be generally viewed as a portion of a shape 120 that has an inner perimeter 126 that forms part of an inner small ellipse 122 and an outer perimeter 128 that forms part of an outer large ellipse 124. The inner and outer ellipses are shown for explanation, and are not actually part of the earpieces in this example implementation. The inner perimeter 126 connects to the body 34 of the tip 60. In some implementations, the large ellipse 124 has a major radius of about 7 mm to about 15 mm, e.g., about 10.75 mm and a minor radius of about 4 mm to about 10 mm, e.g., about 6.75 mm. In some implementations, the small ellipse 122 has a major radius of about 2 mm to about 7 mm, e.g., about 4.65 mm and a minor radius of about 1 mm to about 6 mm, e.g., about 3.75 mm.

In some implementations, the petal flap 40 is more than half of the total size of the shape 120 and is symmetric relative to the short axis 130, 132 of the inner ellipse 122 or the outer ellipse 124. Compared to the shape 120, the flap 40 misses a portion that corresponds to a gap 134, e.g., a fan shaped gap, in the shape 120. In some implementations, the gap 134 has inner perimeter 136 corresponding to a central angle $\beta$ of less than 180 degrees, e.g., about 55 degrees to about 150 degrees or about 85 degrees. The outer perimeter 138 of the gap 134 may correspond to the same central angle $\beta$ or a different angle.

Figure 2E:
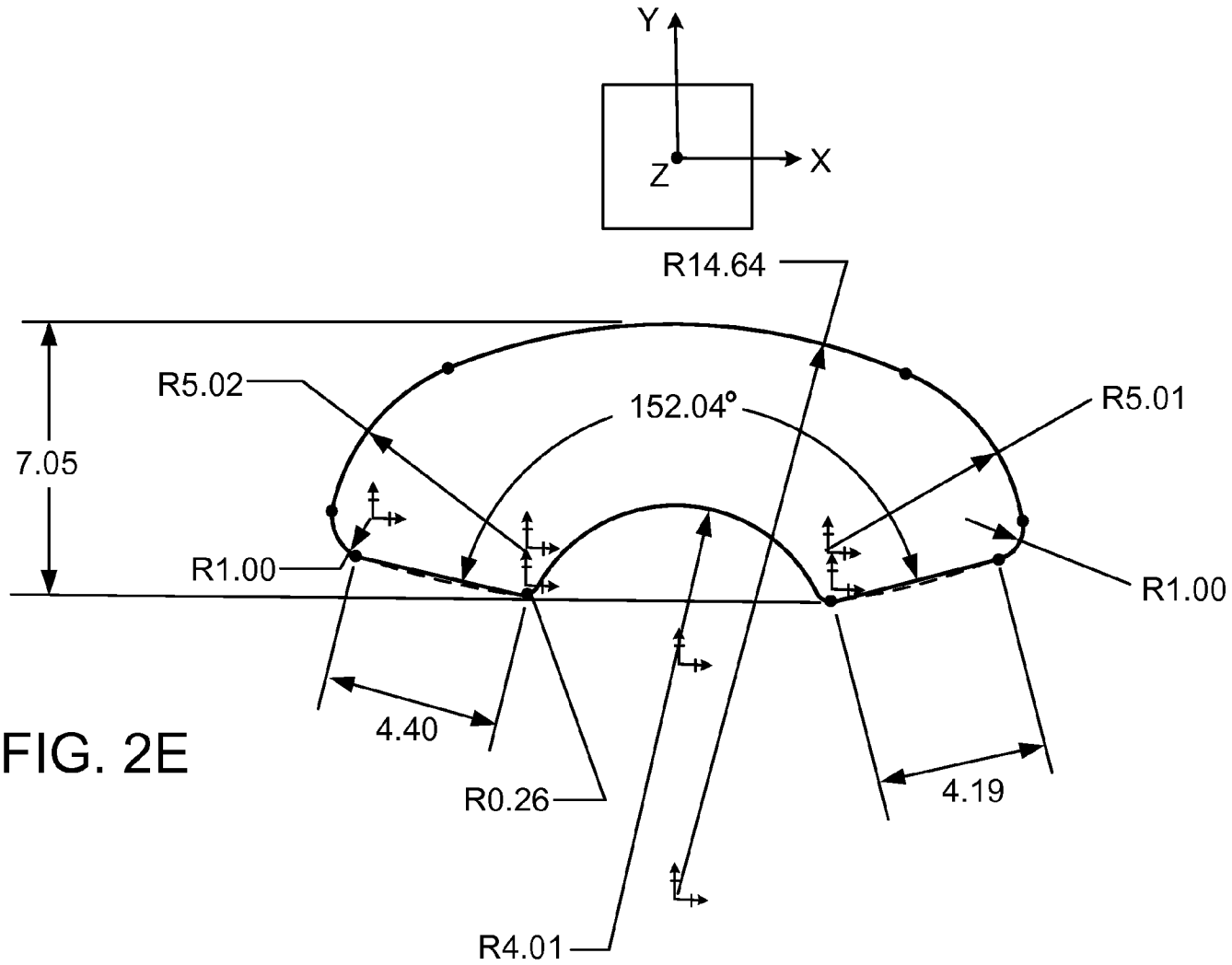
FIGS. 2E and 2F are mechanical drawings of example petal flaps.
Figure 2F:
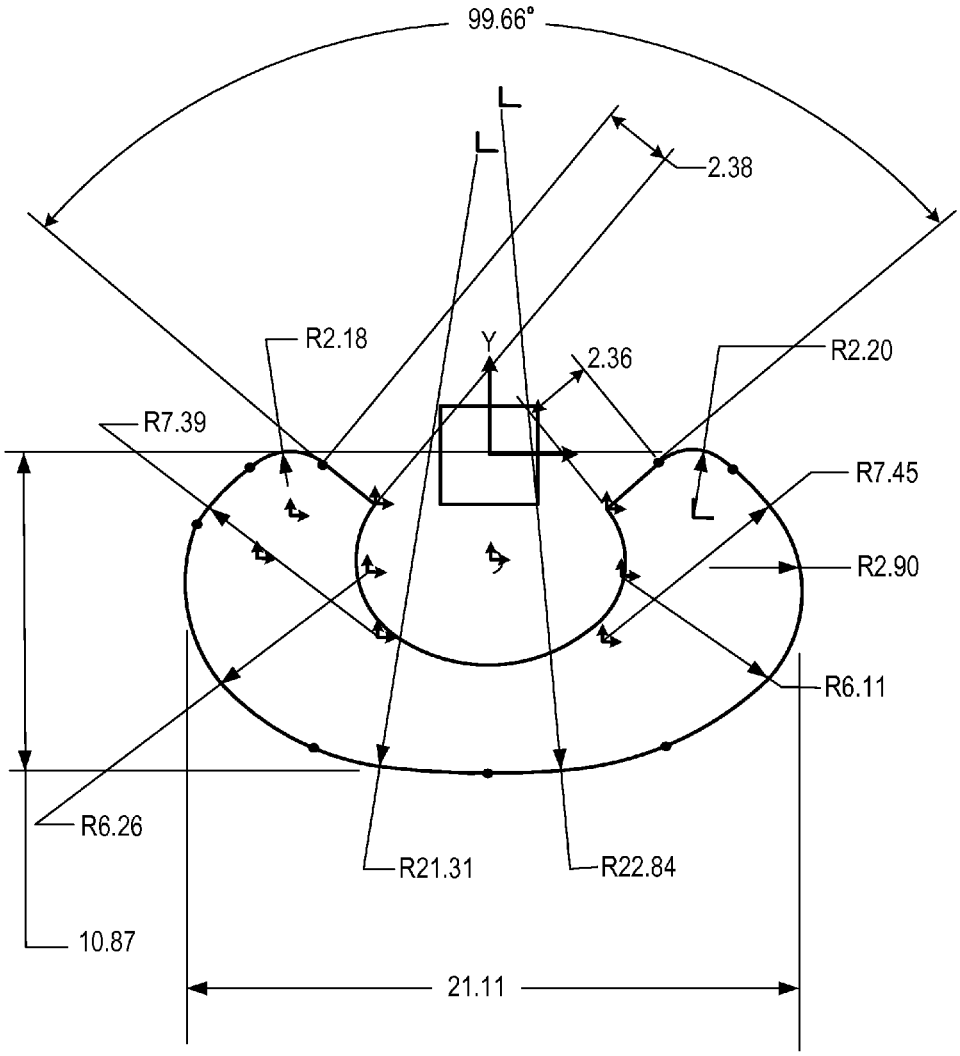
Figure 2G:
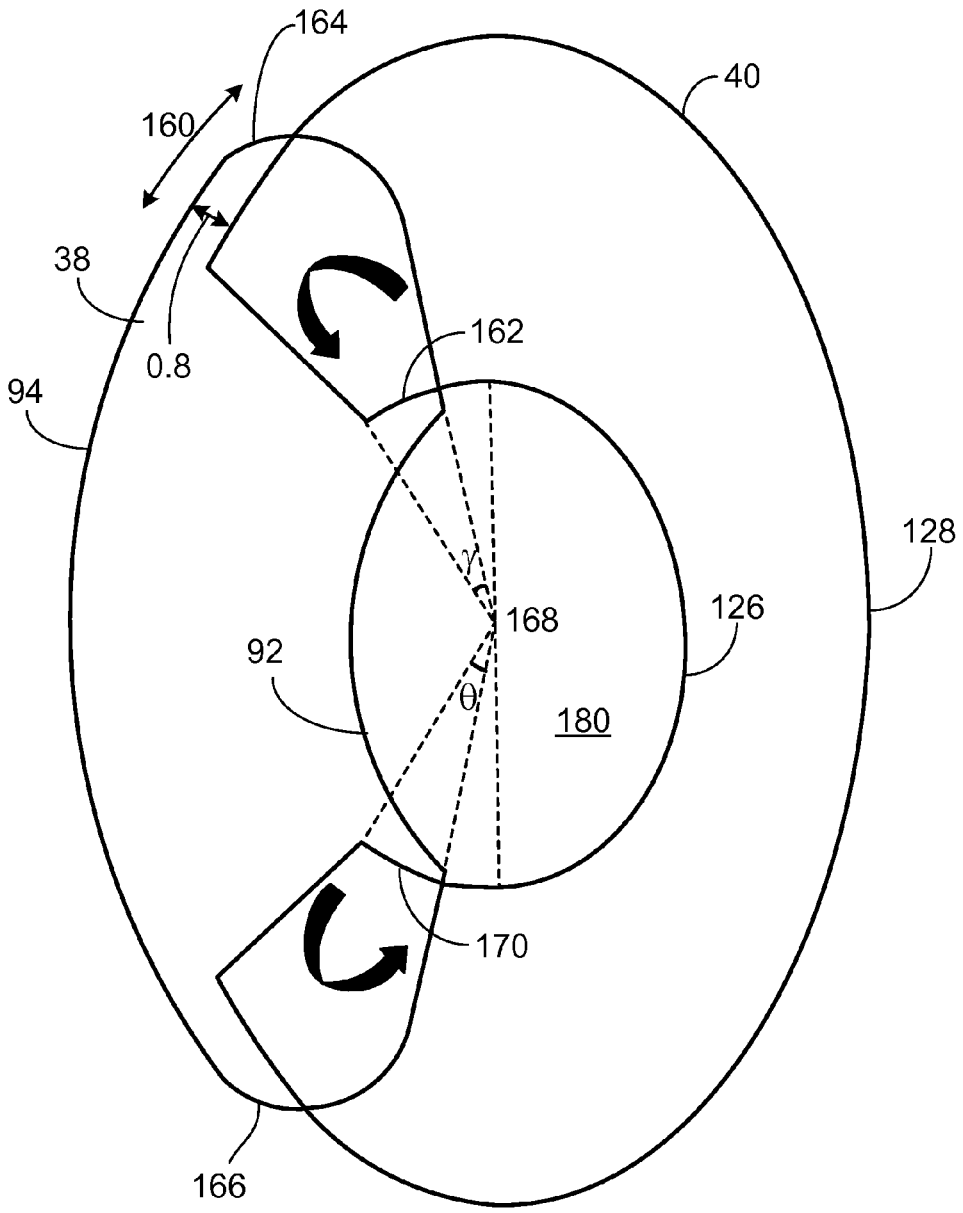
FIG. 2G is a top view of a frusto-conical structure formed by example petal flaps.
Figure 2H:
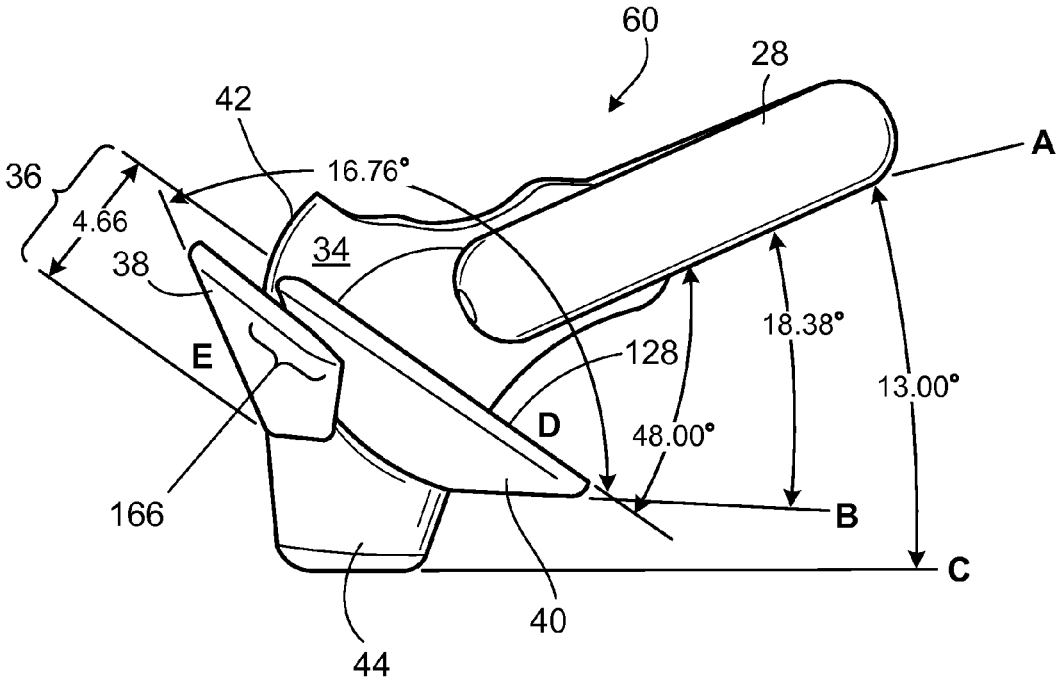
FIGS. 2H, 2I, 2J, and 2K are schematic perspective views of parts of example tips of earpieces.
Figure 2I:
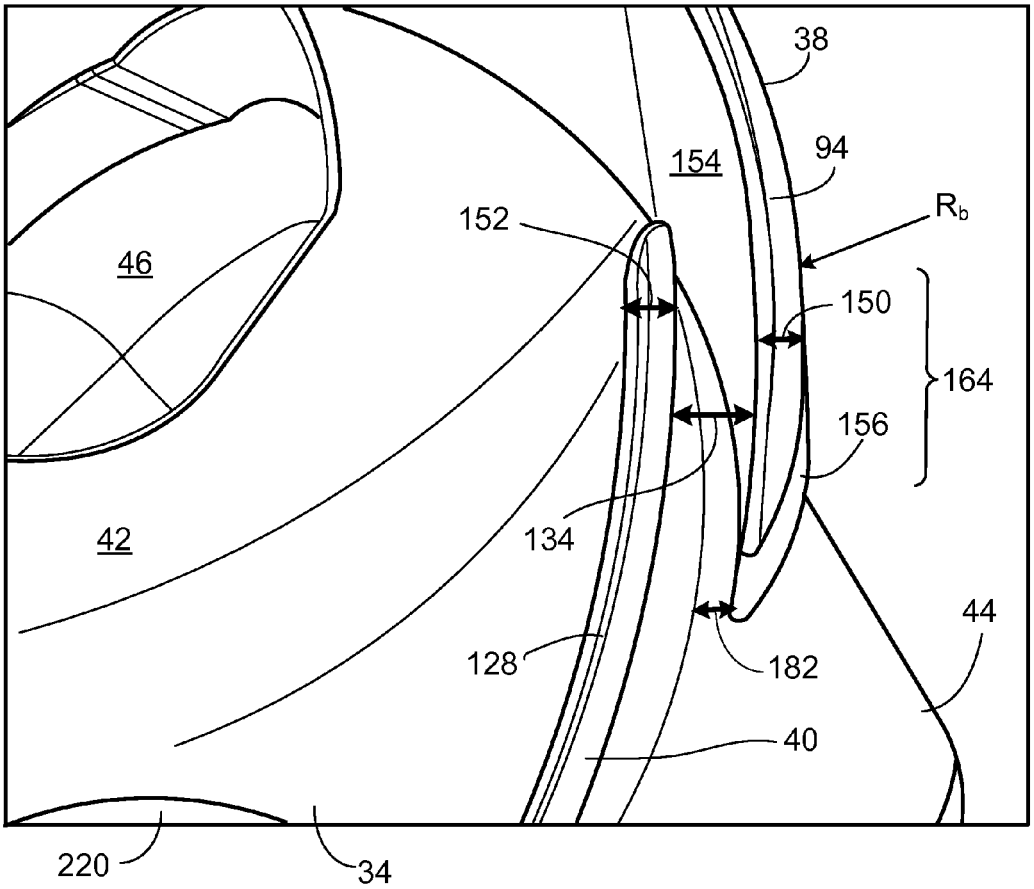

Referring to FIG. 2I, in some implementations, each petal flap 38, 40 has a thickness 150, 152 of about 0.15 mm to about 1.5 mm, e.g., about 0.5 mm. The two flaps can have the same thickness or different thicknesses. An inner surface 154 and an outer surface 156 of the flap 38 can connect at the outer perimeter 94 of the flap 38 through a curved surface, e.g., with a blend radius $R_b$ of about 0.5 mm. The curved surface can provide a smooth touch to the outer perimeter 94. Similarly, the outer perimeter 128 of the flap 40 can also be smooth.

The actual sizes and shapes of the petal flaps 38, 40 can vary based on various factors including, but not limited to, the sizes of user ears, earpiece material properties, e.g., hardness, of the flaps, the manufacturing processes, e.g., the ease of manufacturing, etc. For example, differently sized petal flaps can be used for different groups of users having different ear sizes. The actual sizes of an example set of petal flaps 38, 40 are shown in the mechanical drawings of FIGS. 2E and 2F, respectively. The dimensions in the drawings are in millimeters, unless otherwise specified.

Referring to the examples of FIGS. 2G, 2H, and 2I, the petal flaps 38, 40 on the body 34 of the tip 60 overlap along the peripheral direction 160 at both end regions 164, 166 of the two flaps. For example, a portion 162 of the inner perimeter 126 of the flap 40 overlaps with the flap 38 by an amount that corresponds to a central angle $\gamma$ at a center 168 of the inner perimeter 126. Another portion 170 of the inner perimeter 126 of the flap 40 overlaps with the flap 38 by an amount that corresponds to a central angles $\theta$ at the center 168. In some implementations, the angles $\gamma$, $\theta$ can be the same or can be different and are in the range of about 10 degrees to about 60 degrees, e.g., about 30 degrees to about 40 degrees, or about 36 degrees.

In this example implementation, the inner perimeters 92, 126 of the flaps 38, 40 are connected to the body 34 to form the top of the frusto-conical structure 36 that surrounds the body 34. The front part 44 of the body 34 extends beyond the frusto-conical structure 36 through an opening 180 defined by the perimeters 92, 126. Referring again to FIG. 2I, in some implementations, a bottom gap 182 formed between the two flaps 38, 40 on the body 34 has a width of about 0 mm to about 1 mm, e.g., about 0.35 mm. In some implementations, the outer perimeters 94, 128 of the flaps 38, 40 form a top gap having a width of about 0.1 mm to about 1.6 mm, e.g., about 0.8 mm.

In the example shown in FIGS. 2G-2I, the flap 38 is arranged in front of the flap 40 such that in the overlapping regions 164, 166, the outer surface 156 of the flap 38 is closer to a front end of the front part 44 than the outer surface of the flap 44. The flaps 38, 40 can also be arranged in a reverse sequence in which the flap 40 is arranged in front of the flap 38. The location of the flap 38 on the body 34 is chosen such that when the tip 60 is placed and secured in an ear, the flap 38 is on the inner side of the tragus of the ear (see, e.g., FIG. 1A). The relatively small size of the flap 38 can allow the flap to flexibly conform to the tragus shapes of different ears. For some users, this configuration may provide for a more comfortable fit and a more consistent seal to the ear.

For some users, the overlap between the two flaps in the end regions 164, 166 can also provide seal to an ear to reduce an amount of passive noise entering the ear canal. When the outer surfaces of the flaps 38, 40 are compressed against the ear wall, the flaps can bend towards the body 34 such that a size of the bottom 80 (see, e.g., FIG. 2B) of the frusto-conical structure 36 is reduced. During compression, the inner perimeters 92, 126 of the flaps remain stationary relative to the body 34 of the tip 60, while the outer perimeters 94, 128 slide towards each other within regions 164, 166. As a result, along the outer perimeters, the flaps 38, 40 overlap more than when they are uncompressed. For some users, the increased overlap further may seal the entry to the ear without the tip being deep into the ear canal.

In some implementations, when the main angle of a cone formed by one or more flaps becomes large, i.e., when the cone begins to look more like a disk, the tip 60 may no longer be able to properly locate itself in the ear as its proper position becomes ambiguous. In some examples, the front part 44 of the tip 60 engages the ear canal entrance beyond the sealing location of the flap portions when the tip is properly positioned in the user's ear. The nozzle can extend past the connection of flaps 40 and 38 with the body 34 and directly engage some portions of a user ear canal. This nozzle can increase the ability of the tip to be properly positioned in the ear and can allow the tip to achieve greater stability. The nozzle is sized so that it is smaller than typical ear canal opening, such that it does not create a static force on the ear canal wall. Rather, the tip is used as a locating feature during installation to help reduce fit ambiguity, which may occur when there is no such nozzle. In some implementations, the nozzle has a profile that is in the shape of an ellipse. The ellipse can have a major axis radius that ranges from about 1 mm to about 5 mm, e.g., about 3.25 mm, and a minor axis radius that ranges from about 0.5 mm to about 3 mm, e.g., about 1.25 mm. In some implementations, the nozzle can have a length that ranges from about 1 mm to about 8 mm, e.g., about 4.25 mm.

In some implementations (e.g., FIGS. 2A and 2I), to facilitate bending of the flaps 38, 40 towards the body 34, the generally round outer surface of the back part 42 of the body 34 is modified in regions 220, 222 under the flaps 40, 38. For example, in the regions 220, 222, body materials are removed to form flat surfaces so that the flaps 40, 38 can bend towards the regions 220, 222 without the body materials substantially obstructing the bending.

The flaps can bend by any appropriate amount. The flexibility of the flaps during compression can also allow the tip to consistently fit ears of different sizes and geometries, thereby reducing the need to customize the configuration of the tip for each user. The amount of compression and increased overlap needed or experienced by different users may be different.

The locations and orientations of the flaps 38, 40 relative to the front part 44 of the body 34 can be chosen based on different factors, including for example, manufacturing processes or sizes and geometries of user ears. In some implementations, the tip 60 can be manufactured in several (e.g., three) different sizes, one for a group of users who have relatively small ears, e.g., children, one for a group of users who have medium-sized ears, e.g., a majority of adults, and one for a group of users who have large sized ears. In addition to the arrangement of the flaps 38, 40, as described herein, the sizes and shapes of the flaps can be different for differently shaped tips.

FIG. 2H shows a perspective side view of a part of the tip 60 in a plane. For the purpose of describing example sizes of the part shown in the figure, five lines A-E in the same plane are defined as follows:

Line A is in a plane substantially parallel to the concha plane, which can be substantially parallel to the sagittal plane. Line B is in a plane tangent to the front surface of the petal 40. Line C is in a plane tangent to the front surface of the nozzle 44. Line D is in a plane tangent to the outer perimeter 128 of the petal 40. Line E is in a plane tangent to the front surface of the petal 38.

Figure 2J:
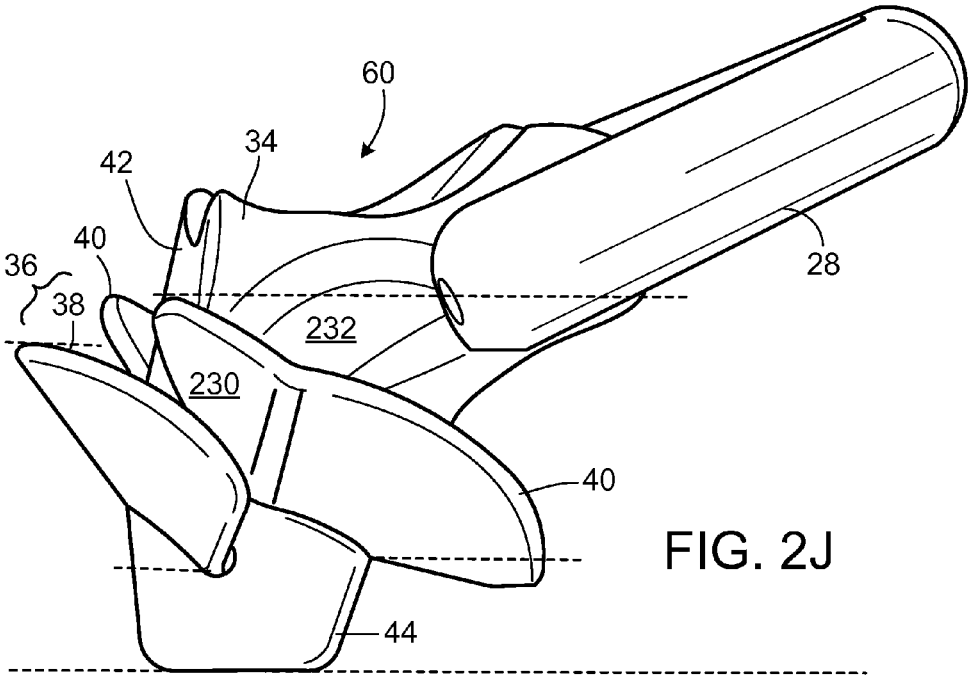
Figure 2K:
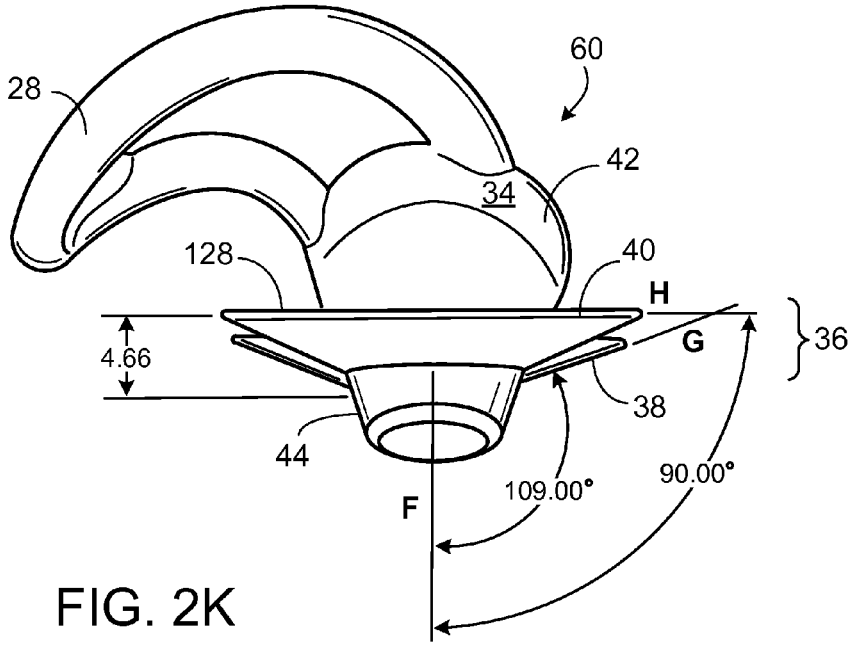

In some implementations, the lines B and E, or the front surfaces of the petals 38, 40 form an angle of about 60° to about 180°, e.g., about 116.76° as shown in the figure as an example. This angle defines the angle of the top conical section formed by the petals and locates the petals relative to each other in this view. In some implementations, the lines A and B, or the front surface of the petal 40 and the line A, form an angle of about −30° to about 60°, e.g., about 15.38° as shown in the figure as an example. This angle locates the two petals 38, 40 on the body 34. In some implementations, the lines A and D, or the outer perimeter 128 of the petal 40 and the line 40, form an angle of about 10° to about 85°, e.g., about 48.00° in the figure as an example. In some implementations, the height of the frusto-conical structure 36 is about 1 mm to about 8 mm, e.g., about 4.66 mm as shown in the figure as an example. The height can be defined as a distance from the rearmost point on the petal 40 to the front most point on the petal 38. This distance can be measured along a line that is normal to line D or to a plane parallel to the back surface of the petal 40. In some implementations, the lines A and C, or the nozzle face and the line A, form an angle of about −20° to about 60°, e.g., about 13.00° as shown in the figure as an example. FIG. 2K shows a perspective view of a part of the tip 60 in the sagittal plane. For the purpose of describing example sizes of the part shown in the figure, three lines F-H in the same sagittal plane are defined as follows:

Line F is in a plane that is substantially parallel to the plane of FIG. 2H. Line G is in a plane tangent to the front surface of the petal 38. Line H is in a plane tangent to the outer perimeter 128 of the petal 40.

In some implementations, the side angle of the conical section formed by the petals 38, 40 is about 60° to about 180°, e.g., about 141.05° as shown in the figure as an example. The side angle locates the petals 38, 40 relative to each other in this view. In some implementations, the lines F and G, or the conical surface defined by the petals and the line F, form an angle of about 45° to about 150°, e.g., about 109.00°. This angle defines the pitch of the petals 38, 40 on the body 34. In some implementations, the lines F and H, or the outer perimeter 128 of the petal 40 and the line 40, form an angle of about 45° to about 135°, e.g., about 90.00°. Similar to the view shown in FIG. 2H, in the sagittal plane, the height of the frusto-conical structure 36 is about 1 mm to about 8 mm, e.g., about 4.66 mm.

In other implementations, lines or planes other than those shown in FIGS. 2H and 2K can be defined or used in determining the different sizes of the tip 60.

The shapes and the sizes of the flaps 38, 40 and the frusto-conical structure 36 can vary while still providing various advantages for various users. For example, referring to FIG. 2J, the flaps 38, 40 may not have a smooth surface that follows the shape of a cone. Instead the flaps may have flat regions, such as a region 230 of the flap 40, connected with other regions through corners, such as a corner 232 of the flap 40.

The overlapping region(s) between ends of one or more flaps can have different features to provide different degrees of seal to the ear. For example, as described previously, the overlapping region can allow the ear to be fully sealed. When inserted in a user's ear, the ends of the flap(s) have very little to no gap in the overlapping region. Furthermore, the thickness of the flap(s) can taper down from the inner perimeter to the outer perimeter to be very thin so that the compressed flap(s) create little to no air gap at the sealing location. In some implementations, the overlapping regions can provide consistent leak paths to the ear canal. In this example, the flap thickness may increase from the inner perimeter to the outer perimeter and the gap between flaps is chosen to be larger than the gap used in a tip for providing complete seals. Along the circumference of the tip, the transition from one end of a flap to another end of flap or another end of a different flap is relatively abrupt so that there is a leak path formed between the flaps or between the flaps and the user's ear canal entrance.

Referring again to FIG. 2A, the tip 60 can be manufactured by molding. In some implementations, all parts of the tip 60, including the sealing structure 48 and the positioning and retaining structure 28, can be formed integrally. In some implementations, the sealing structure 48 including the body 34 and the flaps 38, 40 can be formed integrally through molding using a suitable material including silicone in 8 to 70 Shore A durometer, e.g., 12, 16, or 20 durometer. Other suitable materials can include TPEs, urethanes, or other rubber-type materials. The positioning and retaining structure 28 may be formed integrally through molding. The positioning and retaining structure 28 may then be connected to the sealing structure 48. In some implementations, the tip 60 can be manufactured in a double injection molding process that molds an insert piece with a hard durometer material first and then molds a soft durometer material around the insert piece. In some implementations, the tip 60 can be coated with an anti-dust coating. Example coating materials is described in U.S. Pat. No. 8,600,096, the entire content of which is incorporated herein by reference.

Figure 4A:
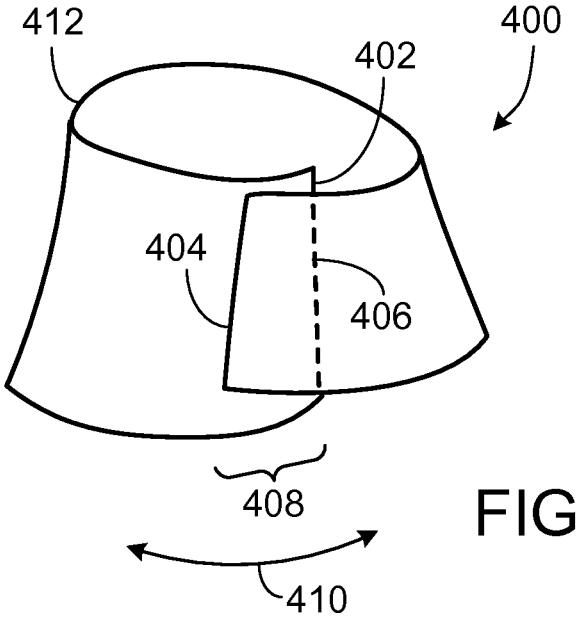
FIG. 4A is a schematic view of a frusto-conical structure.

Although two petal flaps are described with respect to FIGS. 2 and 2A-2J, a tip can also include a different number of petal flaps. For example, referring to FIG. 4A, in some implementations, a tip can include a single flap 400 that has a general frusto-conical shape similar to the structure shown in FIG. 2B. The flap 400 may include a break 402 formed by two ends 404, 406 that overlap along a peripheral direction 410 in an overlapping region 408. The flap 400 can be connected to a body of the tip at an inner perimeter 412. The overlapping region 408 can have structures and functions similar to those of the overlapping regions of the flaps 38, 40 described elsewhere herein.

Figure 4B:
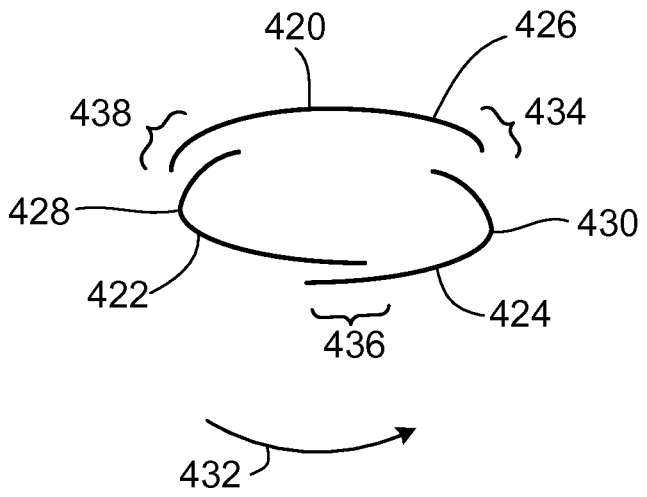
FIGS. 4B and 4C are schematic top views of inner perimeters of multiple flaps.
Figure 4C:
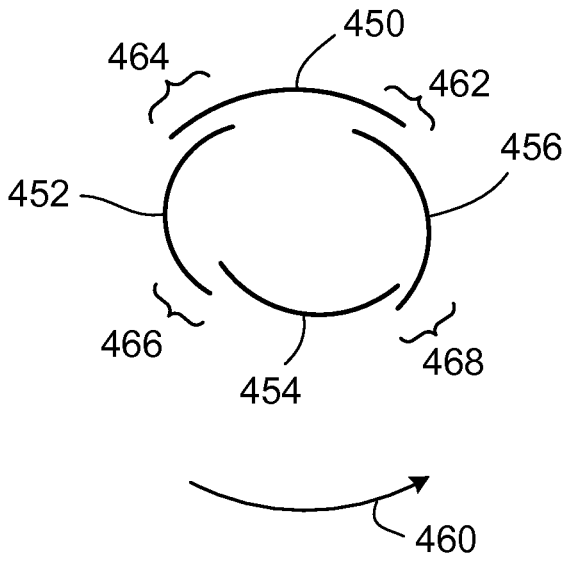

In other examples, more than two, e.g., three, four, five, or more, petal flaps can be used in a single earpiece. For example, FIG. 4B shows the top view of the inner perimeters 420, 422, 424 of three flaps 426, 428, 430. The edges of the flaps along the peripheral direction 432 overlap in regions 434, 436, and 438, which can have features and perform functions similar to those of the overlapping regions of the flaps 38, 40 described herein. FIG. 4C shows the top view of the inner perimeters 450, 452, 454, 456 of four flaps. The edges of the flaps along the peripheral direction 460 overlap in overlapping regions 462, 464, 466, 468, which can have features and can perform functions similar to those of the overlapping regions of the flaps 38, 40 described herein.

In use, the earpiece 20 of FIG. 2 is inserted into an ear, such as the ear 10, 12, 14, by moving the front part 44 of the sealing structure 48 towards the entrance of the ear canal. As described herein, in response to force produced upon compression against the ear canal, the geometry of the frusto-conical structure 36 changes. The petal flaps 38, 40 may also slide relative to each other to adapt to the geometry of the ear or ear canal and to seal the ear canal. The earpiece 20 can be oriented and held in place in a sealing position using the positioning and retaining structure 28 and other portions of the earpiece.

Figure 3:
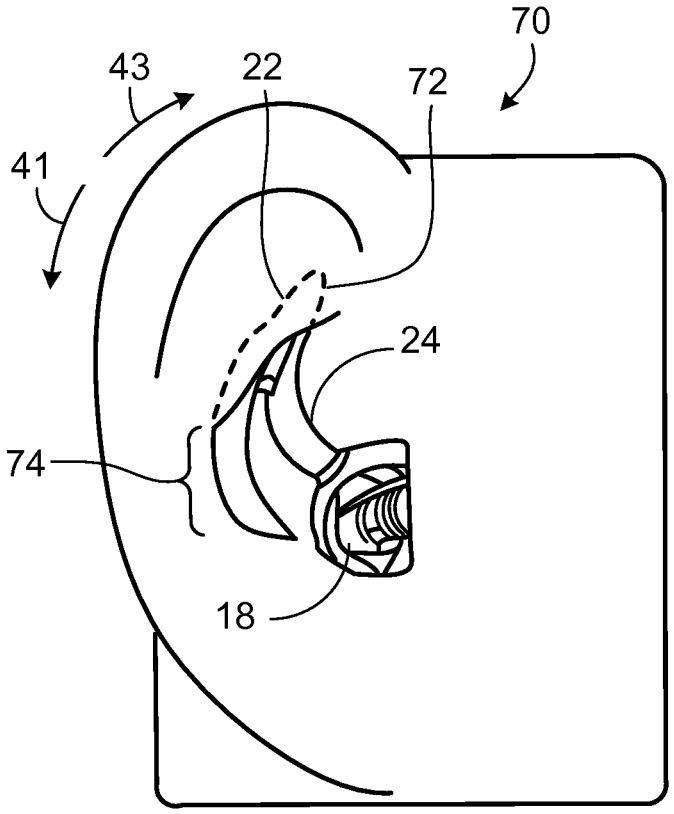
FIG. 3 is a schematic lateral view of an example ear piece in a human ear.

An example process in which an earpiece is placed and held in an ear is explained in connection with FIG. 3. The earpiece 20 of FIG. 2 is placed in a right ear 70 and pushed inward. The earpiece can be rotated counter-clockwise as indicated by an arrow 41. Pushing the tip 60 of the earpiece 20 into the ear generates forces that cause the outer leg 22 of the positioning and retaining structure 28 to move into position underneath the anti-helix of the ear 70. The pushing also generates forces that cause the front part 44 of the sealing structure 48 to enter the ear canal by a small amount (not shown), depending on the dimensions and geometry of the entrance to the ear canal.

The earpiece 20 is then rotated clockwise as indicated by arrow 41 until one or more conditions occur so that the earpiece cannot be further rotated. The conditions can include, e.g.: an extremity 72 of the tip contacting the base of the helix; the inner leg 24 contacting the base of the helix; or the extremity 72 becoming wedged behind the anti-helix in the cymba concha region. Though the positioning and retaining structure provides all three conditions (hereinafter referred to as "modes)", not all three conditions will or need to occur for all users, but at least one of the modes will occur for most users. Which condition(s) occur(s) is dependent on the size and geometry of the user's ears.

Rotating the earpiece clockwise can cause the extremity 72 and the outer leg 22 to engage the cymba concha region and seat beneath the anti-helix of the ear 70. When the tip and the positioning and retaining structure 28 are in place, the positioning and retaining structure and/or body contact the ear of most people in at least two, and in some people more, of several ways: a length 74 of the outer leg 22 contacts the anti-helix at the rear of the concha; the extremity 72 of the positioning and retaining structure 28 is underneath the anti-helix; portions of the outer leg 22 or the tip 60 or both are underneath the anti-tragus; and the tip 60 contacts at the entrance to the ear canal under the tragus. The two or more points of contact hold the earpiece in position for many users, providing greater stability for such users. The distribution of force, and the compliance of the portions of the body and the outer leg that contact the ear may lessen pressure on the ear and result in a more comfortable fit.

It may be desirable to place the earpiece in the ear so that it is oriented properly, so that it is stable (that is, stays in the ear), so that it is comfortable, and, for some applications so that it provides significant passive attenuation of ambient noise. One way of providing stability and proper orientation is described above and is described more completely in U.S. patent application Ser. No. 12/860,531, incorporated herein by reference.

Elements of different implementations described herein may be combined to form other embodiments not specifically set forth above. Elements may be left out of the structures described herein without adversely affecting their operation. Furthermore, various separate elements may be combined into one or more individual elements to perform the functions described herein.

What is claimed is:

1. An ear tip for an earpiece, comprising:

a body having a front part and a back part, the front part being configured to enter further into an ear than the back part; and two flexible flaps extending from the body, the two flexible flaps comprising a first flap and a second flap that together form a generally frusto-conical shape around the body, at least part of the body being partially enclosed by the two flexible flaps, the first flap and the second flap being connected to the body at different distances between the front part and the back part, and the first flap and the second flap each being connected to the body at an angle relative to a tangent to a front surface of the front part, an angle for connecting the first flap to the body being different from an angle for connecting the second flap to the body.

2. The ear tip of claim 1, wherein the first flap is smaller in size than the second flap.

3. The ear tip of claim 2, wherein the first flap is connected to the body at a location such that when the ear tip is held in the ear with the front part of the body positioned at the entrance to an ear canal, the first flap is on an inner side of the tragus of the ear.

4. The ear tip of claim 2, wherein the first flap has the shape of a portion of a first oval and has a size smaller than half of the first oval.

5. The ear tip of claim 2, wherein the second flap has the shape of a portion of a second oval and has a size larger than half of the second oval.

6. The ear tip of claim 1, wherein the first flap is connected to the body at a first inner perimeter, and has a first outer perimeter and first and second ends extending between the first inner perimeter and the first outer perimeter; and the a second flap of the two flaps is connected to the body at a second inner perimeter, and has a second outer perimeter and third and fourth ends extending between the second inner perimeter and the second outer perimeter, the first end overlapping with the third end along the first and second inner perimeter, and the second end overlapping with the fourth end along the first and second inner perimeter.

7. The ear tip of claim 6, wherein the first and third ends are separated by a gap having a width of about 0 mm to about 1 mm at the first and second perimeters.

8. The ear tip of claim 6, wherein the first and third ends are separated by a gap having a width of about 0.1 mm to about 1.6 mm at the first and second outer perimeters.

9. The ear tip of claim 1, wherein each flap has a thickness of about 0.15 mm to about 1.5 mm.

10. An ear tip for an earpiece, comprising:

a body having a front part and a back part, the front part being configured to enter further into an ear than the back part; and two flexible flaps comprising a first flap and a second flap that together form a frusto-conical structure surrounding the body, at least part of the body being partially enclosed by the frusto-conical structure, and wherein each of the two flexible flaps has an inner perimeter that is closer to the front part than to the back part and an outer perimeter that is closer to the back part than to the front part, the two flexible flaps also each comprising two ends each extending between the inner perimeter and the outer perimeter, at least two ends of the two flexible flaps overlapping along a peripheral direction of the inner or outer perimeters in an overlapping region;

wherein the inner perimeter of the first flap and the inner perimeter of second flap are connected to the body at different distances between the front part and the back part, and wherein the first flap and the second flap are each connected to the body at an angle relative to a tangent to a front surface of the front part, an angle for connecting the first flap to the body being different from an angle for connecting the second flap to the body.

11. The ear tip of claim 10, wherein the back part comprises a surface having a first region having a round shape and one or more second, flat regions under the one or more flaps.

12. The ear tip of claim 10, wherein the two flexible flaps are configured to bend towards the body so that the ends in the overlapping region slide towards each other along the peripheral direction to increase an amount of the overlap.

13. The ear tip of claim 10, wherein the ear tip comprises one or more additional flexible flaps.

14. The ear tip of claim 10, wherein the two flexible flaps comprise silicone.

15. The ear tip of claim 10, comprising exactly two flexible flaps.

16. The ear tip of claim 10, wherein the first flap is smaller in size than the second flap.

17. An earpiece comprising:

a body defining an opening as an acoustic passage to conduct sound waves, the body having a front part and a back part, the front part being configured to enter further into an ear than the back part;

two flaps connected to the body, the two flaps comprising first flap and a second flap, each flap being flexible in response to applied force so as to enclose at least part of the body, the first flap and the second flap being connected to the body at different distances between the front part and the back part, and the first flap and the second flap each being connected to the body at an angle relative to a tangent to a front surface of the front part, an angle for connecting the first flap to the body being different from an angle for connecting the second flap to the body; and an acoustic driver configured to radiate sound waves to be conducted through the acoustic passage.

18. The earpiece of claim 17, wherein the two flaps each have an inner perimeter connected to the body and an outer perimeter away from the body, the two flaps also each have two ends each extending between the inner perimeter and the outer perimeter, and at least two ends of the flaps overlap along a peripheral direction of the inner or outer perimeters in an overlapping region.

19. The earpiece of claim 17, wherein the earpiece comprises one or more additional flaps that mutually engage to form a conical structure.

20. An ear tip comprising:

a body having a front part and a back part, the front part being configured to enter further into an ear than the back part;

a positioning and retaining structure; and two or more flexible flaps extending from and connected to the body, the two or more flexible flaps comprising a first flap and a second flap that form a frusto-conical shape, the positioning and retaining structure including a member extending from the body and configured to rest against and apply outward pressure to the antihelix of a user's ear to retain the ear tip in the user's ear, the first flap and the second flap connected to the body at different distances between the front part and the back part, and the first flap and the second flap each being connected to the body at an angle relative to a tangent to a front surface of the front part, an angle for connecting the first flap to the body being different from an angle for connecting the second flap to the body.

21. The ear tip of claim 20, wherein the frusto-conical shape has an aperture angle of about 30 degrees to about 90 degrees.

22. The ear tip of claim 20, wherein the two or more flexible flaps have ends that overlap in an overlapping region.

23. The ear tip of claim 22, wherein the positioning and retaining structure forms a consistent leak of sound external to the human ear to the human ear in the overlapping region.

24. The ear tip of claim 22, wherein the front part extends beyond the flaps, and at least part of the back part is partially enclosed by the one or more flaps.

* * * * *